US005979681A

United States Patent [19]

Varlet et al.

[11] Patent Number: 5,979,681

[45] Date of Patent: Nov. 9, 1999

[54] CHILD RESISTANT ATTACHMENT FOR CONTAINERS

[75] Inventors: Jean-Luc André Patrick Varlet, Uccle; Jelle Dankert Vuijk, Brussels; Johan Willy Declerck, Ichtegem; Nady Bilani, Strombeek-Bever, all of Belgium

[73] Assignee: The Procter & Gamble Company, Cincinnati, Ohio

[21] Appl. No.: 09/091,627

[22] PCT Filed: Dec. 9, 1996

[86] PCT No.: PCT/US96/19866

§ 371 Date: Nov. 13, 1998

§ 102(e) Date: Nov. 13, 1998

[87] PCT Pub. No.: WO97/23387

PCT Pub. Date: Jul. 3, 1997

[30] Foreign Application Priority Data

Dec. 21, 1995 [EP] European Pat. Off. ..... 95203581

[51] Int. Cl.[6] ..... B65D 50/04; B65D 41/34

[52] U.S. Cl. ..... 215/216; 215/221; 215/252; 215/258

[58] Field of Search ..... 215/216, 217, 215/219, 221, 223, 250, 252, 253, 258; 220/214, 281

[56] References Cited

U.S. PATENT DOCUMENTS

| | | | |
|---|---|---|---|
| 3,958,709 | 5/1976 | Nixdorff | 215/221 |
| 4,752,013 | 6/1988 | Miller et al. | 215/216 |
| 4,752,014 | 6/1988 | House et al. | 215/216 |
| 5,381,911 | 1/1995 | Teicher et al. | 215/216 |
| 5,413,233 | 5/1995 | Hall | 215/209 |
| 5,577,624 | 11/1996 | Berta et al. | 215/221 |

*Primary Examiner*—Stephen K. Cronin
*Attorney, Agent, or Firm*—William Scott Andes; Vanessa M. Nichols

[57] ABSTRACT

A child resistant package comprises a container, a transition piece (112) and a closure (114). A pushtab (30, 130 or 230) on either the closure or the transition piece and an interlocking tooth (32, 132 or 232) on the other of the closure or the transition piece form the child resistant feature of the package. The pushtab (130) is moved inwardly to disengage the pushtab from the interlocking tooth (132) so that the closure may be unthreaded from the container. The transition piece and the closure are molded in a single piece in one molding process. The frangible connections (40) between the closure and the transition piece break upon the unthreading of the closure for the first time to give a tamper indication.

10 Claims, 5 Drawing Sheets

CHILD RESISTANT ATTACHMENT FOR CONTAINERS

FIELD OF THE INVENTION

The present invention relates to a package which is resistant to opening by the majority of children, yet which can be opened without undue difficulty by adults, also by those whose manual dexterity may, at least to a degree, be impaired.

BACKGROUND OF THE INVENTION

Child resistant packaging is understood to be a important concept for preventing inadvertent access by children, for example, to potentially dangerous liquid or dry products. However, inclusion of the child resistant feature adds difficulty and frustration for the adult user when attempting to open the package. Due to the difficulty in opening child resistant packages, many persons, especially elderly adults which may also have impaired strength and dexterity, could prefer a non-child resistant package substitute. Alternatively, when dangerous products are purchased in child resistant packages by adults, the child resistant package is often not reclosed in order to defeat the child resistant feature. As a result, the danger of child poisonings may increase in the homes.

The aforementioned problems are generally recognized in the packaging industry. Attempts to deal with these problems are also disclosed in the patent literature. For example, U.S. Pat. No. 4,948,002 issued to Thornock et al. on Aug. 14, 1990 discloses a package comprising a bottle, a collar which is secured in place over the uppermost portion of the bottle and a closure which is secured to the finish portion of the bottle. The collar preferably includes a pair of spring-like pushtabs containing vertical extensions which engage interlocking teeth on the innermost surface of the closure skirt when the closure is fully assembled onto the bottle. To remove the closure, the opposed pushtabs must be manually depressed prior to applying unscrewing torque to the closure to disengage the pushtab extensions from the interlocking teeth on the closure.

The package disclosed in '002 exhibits highly improved child resistance without significantly impeding access by adults. The package of document '002 has the collar as a transition piece between the container and the closure. This transition piece facilitates the engagement between the container and the closure. Nevertheless, this additional piece increases the manufacturing costs of the package. Indeed, to make the container, the transition piece and the closure making up the child resistant package three different manufacturing processes with three different machines are necessary. Usually, the container is blow molded or injection-blow molded, whereas the transition piece and the closure are injected molded. We found that a certain amount of manufacturing costs may be saved, if at least the closure and the transition piece are made in a single molding process, since they have a common manufacturing process.

It is therefore an object of the present invention to provide a transition piece and a closure made in a single molding process for a child resistant package.

SUMMARY OF THE INVENTION

The present invention is a child-resistant package comprising a container, a closure and a transition piece. Said container comprises an upper portion, said upper portion comprising a first attachment means for fixing said transition piece to said container and a first engaging means for engaging said closure to said container. Said transition piece comprises an outer wall and a second attachment means corresponding to said first attachment means of said upper portion of said container. Said closure comprises an outer skirt and a top wall. Said closure further comprises a second engaging means corresponding to said first engaging means of said upper portion of said container. Said transition piece comprises at least one resiliently deformable pushtab and said closure comprises at least an interlocking tooth, or said closure comprises at least one resiliently deformable pushtab and said transition piece comprises at least an interlocking tooth. At least part of said pushtab is inwardly movable when a squeezing force is applied to said inwardly movable part of said pushtab. Said pushtab has an exposed surface contour which generally conforms to the exterior surface contour of the adjacent portions of said outer wall of said transition piece or of said outer skirt of said closure. Said interlocking tooth and said pushtab are so formed and positioned to prevent removing of said closure from said container to open said package unless said pushtab is first depressed to disengage said pushtab from said interlocking tooth before said closure is removed. At least part of said pushtab passes adjacent to the innermost surface of said interlocking tooth when disengaging said closure from said container. A breakable connection connects said closure with said transition piece such that said transition piece and said closure are molded as a single piece in one molding process and said closure can be disconnected from said transition piece when said package is opened for the first time.

DETAILED DESCRIPTION OF THE INVENTION

Figure 1:
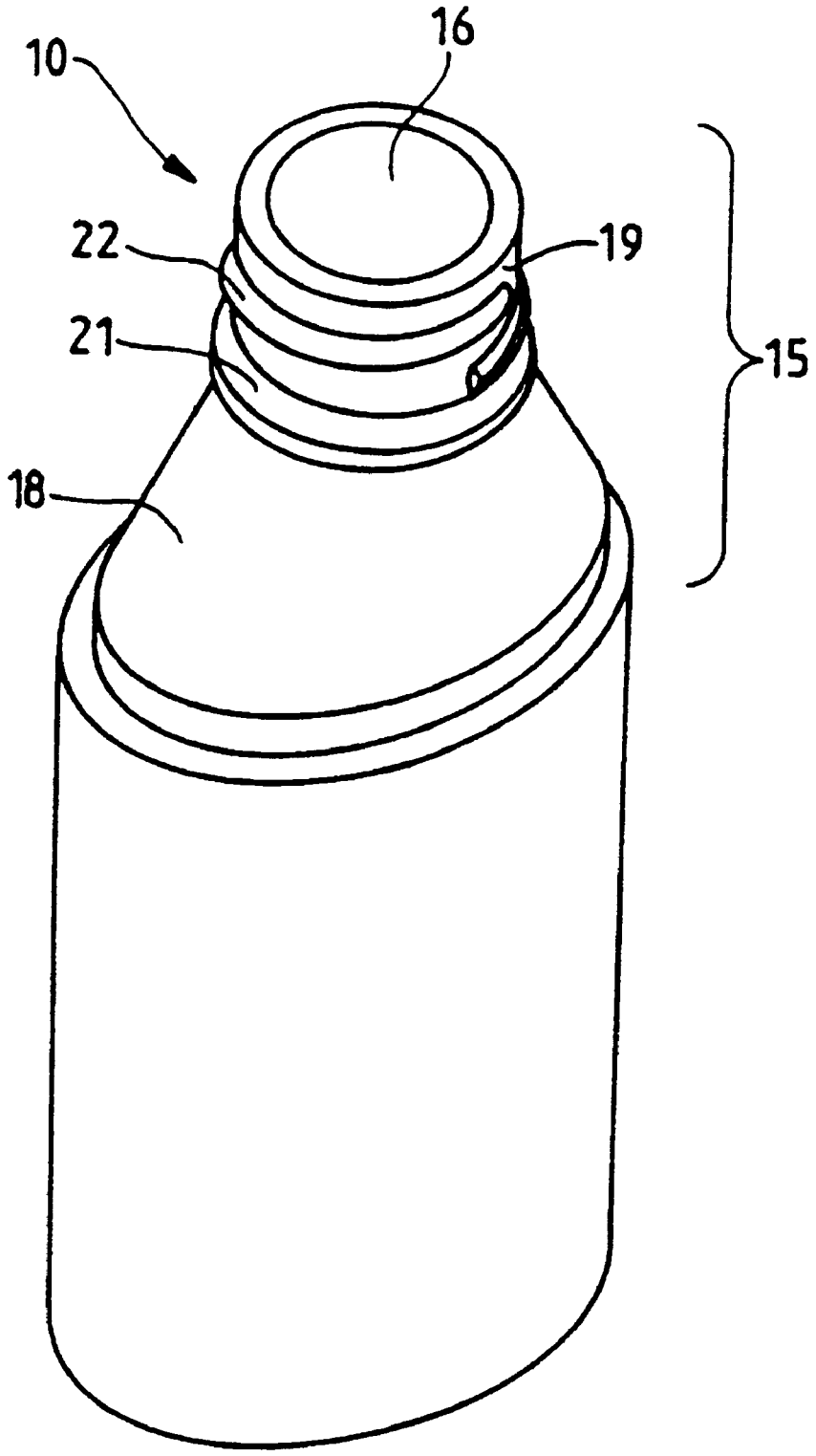
FIG. 1 is a perspective view of a container for a child resistant package according to the present invention.

A container (10) for a package according to the present invention is shown in FIG. 1. The package comprises the container, a closure (12) and a transition piece (14). Said container defines a hollow body comprising an upper portion (15) with an opening (16). Said upper portion comprises a first attachment means (21) and a first engaging means (22). Preferably, said upper portion comprises a shoulder portion (18) and a neck portion (19). Said neck portion surrounds said opening (16) and may further comprise said first attachment and/or said engaging means.

Said container (10) according to the present invention is suitable for storing and dispensing potentially dangerous products. Potentially dangerous products are products which may hurt the health of children and adults when not used in a conscious manner and with the correct dosage. Medicaments and cleaning products are, for example, such products. These products may be in solid, tablet, granular, powdered, semi-solid, paste or liquid form.

Preferably, said container is made of any thermoplastic materials by injection and/or blow moulding. Suitable thermoplastic materials have been extensively described in the art and include vinyl chloride based resins, polymers and co-polymers derived from olefins, acrylic polymers and co-polymers, polyethylene, polypropylene, polystyrene, polyethylene terephthalate, polyethylene terephthalate glycol, or mixtures thereof. Said container can be made of single or multi-layer extrusion of such materials. It can also comprise recycled thermoplastic materials. A preferred thermoplastic material used herein for said container is polypropylene or polyethylene.

Said package further comprises a transition piece (12) and a closure (14). Said transition piece comprises an outer wall (20). Said transition piece is attached onto said upper portion (15) of the container, whereby said outer wall surrounds, but does not close said opening (16). Said transition piece comprises second attachment means corresponding to the first attachment means of said upper portion. Preferably, said second attachment means are located on the innermost surface of said outer wall. The attachment means locks said upper portion and said transition piece together such that said transition piece remains attached to said upper portion even when the closure is engaged or disengaged from said container. For example, when the first and second engaging means enable a rotatable engaging between said container and said closure, said first and second attachment means may be a child resistant snap-fit attachment, or vice versa. In this manner, the movement which may detach said transition piece locked on said container is different from the disengaging movement of said closure.

Preferably, said first attachment means may further comprise means for interlocking said transition piece to said upper portion to prevent any movement or detachment of said transition piece with respect to said upper portion during the disengaging movement of said closure from said container. For example, when both the attachment means and the engaging means are a combination of lugs and screw threads, said upper portion may comprise at least an anti-rotation lug. Said anti-rotation lug interlocks said upper portion with said transition piece. Consequently, any rotation of said transition piece relative to said container is prevented specifically when said closure is rotatably disengaged from said container.

Said closure (14) comprises an outer skirt (23) and a top wall (24). The innermost surface of said outer skirt comprises the second engaging means corresponding to the first engaging means (22) of said upper portion (15). Said first and second engaging means between said closure and said upper portion is preferably a snap-fit or combination of lugs and screw threads. Whichever engaging means is chosen, said engaging means has to ensure that said closure closes said package without leakage. The degree of leak tightness achieved by said closure may be different depending from the specific content of said package, i.e. if the content is liquid, granular or tabletted. Said closure may further comprise an inner skirt. This inner skirt may then comprise said second engaging means.

Figure 2A:
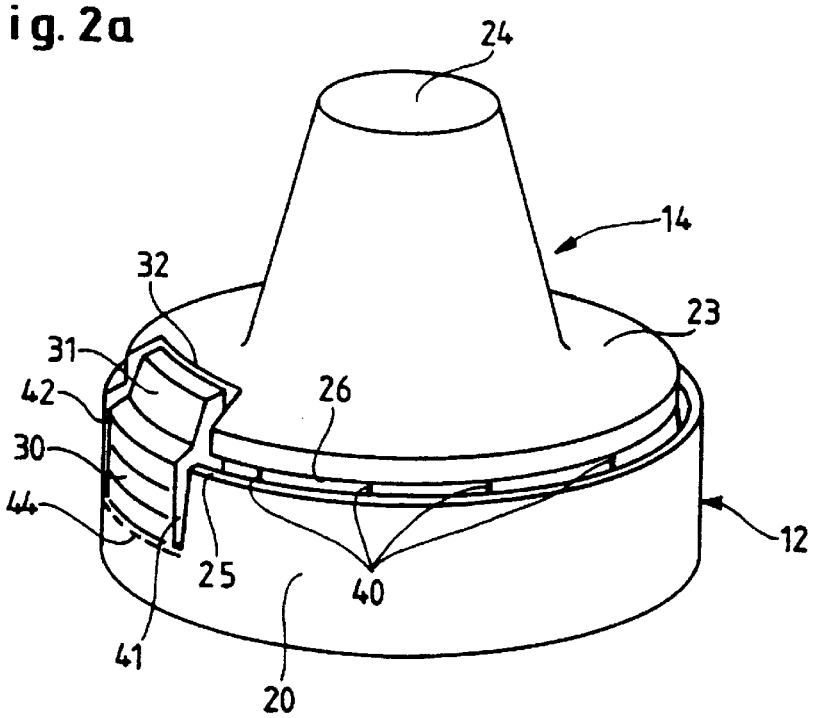
FIGS. 2*a* and 2*b* are perspective front views of a closure and a transition piece for a child resistant package according to the present invention.

The child resistant property of the package according to the present invention is given by the interaction of specific features of said transition piece (12) and said closure (14). In a first embodiment of the present invention, as shown in FIG. 2*a*, said transition piece further comprises at least a pushtab (30) with a upward vertical extension (31) which projects above the upper end (25) of said transition piece and points towards the upper wall (24) of the closure. Said upward vertical extension of said pushtab interlocks with an interlocking tooth (32) when said closure is in its closed rest position. In the following, the "closed rest position" is the position in which said closure is fully threaded onto said upper portion (15) of said container. Said interlocking tooth is preferably located on the innermost surface of the outer skirt (23) of said closure (14).

In another preferred embodiment according to the present invention, the interlocking tooth (31) is formed by a cut through the thickness of the closure (14) as shown in FIG. 2*a*. The cut through the thickness of the closure is such that the upward vertical extension (31) is blocked within the cut. Consequently, the cut acts like an interlocking tooth impeding the movement to the upward vertical extension when the closure is in its closed rest position. The opening of the closure is prevented by the upward vertical extension being blocked within the cut or the interlocking tooth (32). Indeed, the lower end of the closure (26) has a smaller diameter than the upper end (25) of the transition piece and of the pushtab without the upward vertical extension. The diameter is measured between outermost surfaces of the closure or of the transition piece. Thus the upward vertical extension is the only part of the pushtab (30) which can interact with the interlocking tooth.

To remove the closure (14), the pushtab (30) must be manually depressed prior to applying a disengaging movement to the closure. In this manner, the upward vertical extension (31) of the pushtab is pushed further into the cut forming the interlocking tooth (32) on the closure, i.e. the upward vertical extension is disengaged from the interlocking tooth located on the closure. The rest of the pushtab does not interact with the interlocking tooth as explained above for the different diameters between the closure and the pushtab. This removal of the closure needs the cooperation of both hands of the user. Indeed, firstly one hand has to hold the bottle and at the same time depress the spring-like pushtabs. Secondly, the closure has to be unscrewed with the other hand. This means that both hands are needed to actually disengage said child resistant closure from the bottle, which is called in the following a "two hand operation".

The present invention provides also an alternative embodiment of a package comprising a child resistant closure which can be opened with only one hand. In the following this is called "one hand operation", in contrast to the two-hand operation necessary for the embodiment described above. This is achieved, for example, by the transition piece (112) and closure (114) shown in FIG. 3*a*. In this case the closure (114) comprises at least a pushtab (130) and said transition piece (112) comprises at least an interlocking tooth (132). Said pushtab now located on said closure interlocks with the interlocking tooth located on the transition piece when said closure is in its closed rest position. The locking mechanism between the pushtab and the interlocking tooth is similar to the explanation given before for FIG. 1*a*. In this case the vertical extension (131) points downward away from the top wall (24) of the closure. The downward vertical extension of the pushtab has a greater thickness with respect to the rest of the pushtab. In this manner the downward vertical extension can interact with the cut through the thickness forming the interlocking tooth on the transition piece. This is because the upper end of the transition piece has again a greater diameter with respect to the lower end of the closure.

Figure 2B:
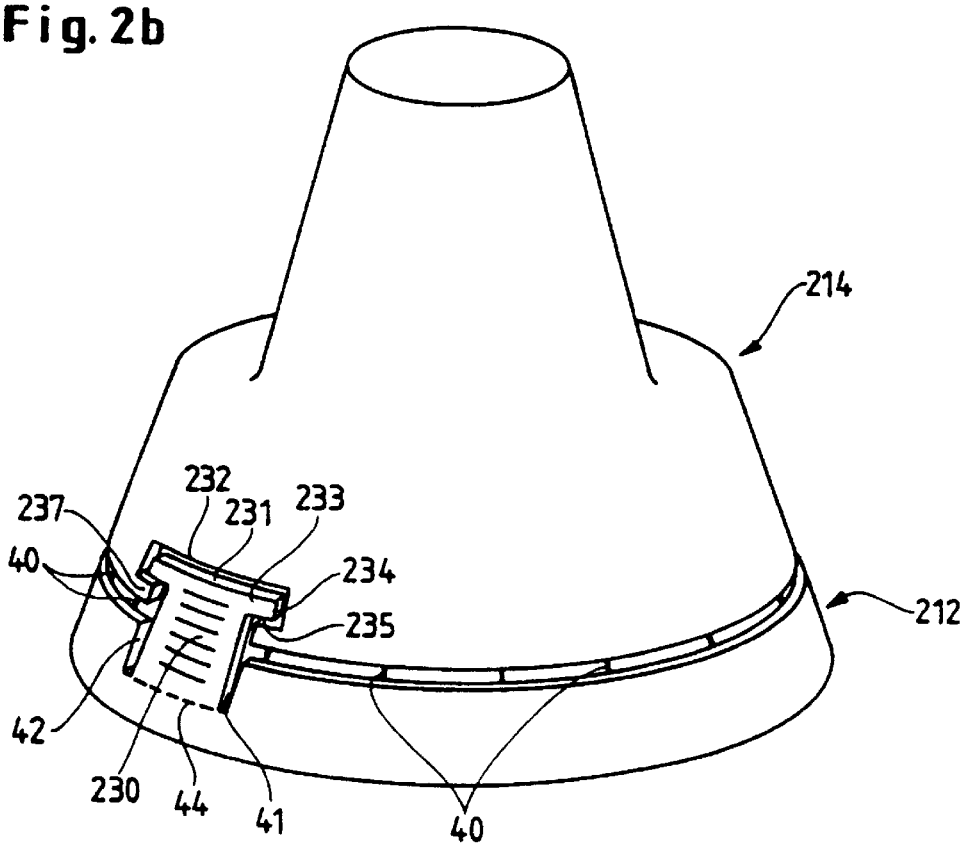
Figure 3B:
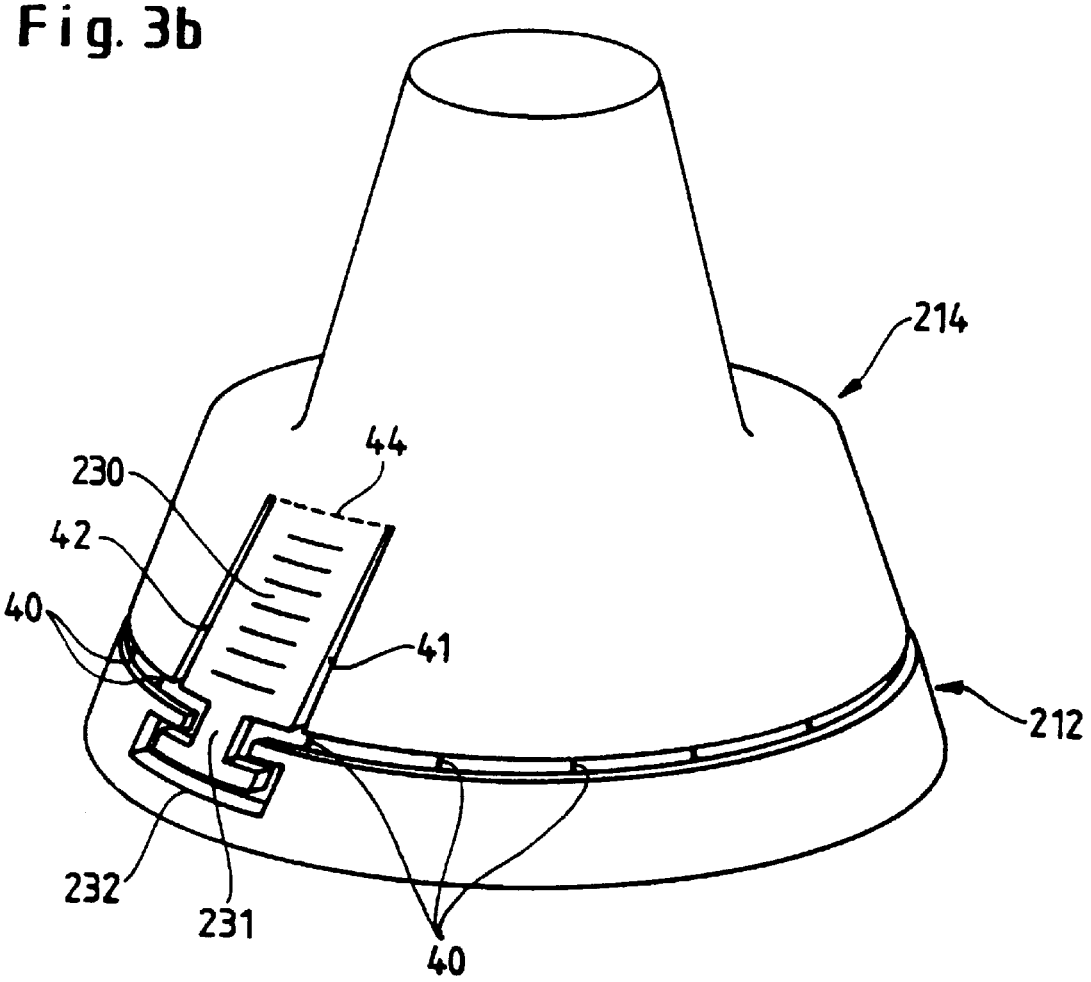
FIGS. 3*a* and 3*b* are perspective front views of other closures and a transition pieces for a child resistant package according to the present invention.
Figure 2C:
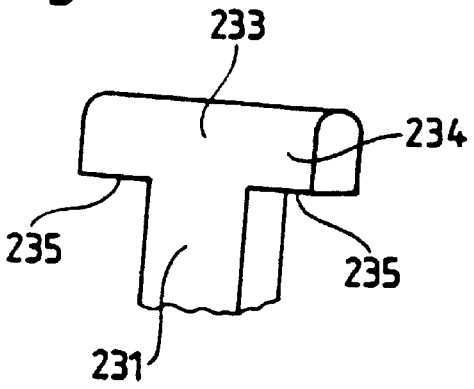
FIG. 2*c* is a detailed view of a vertical extension of FIGS. 2*b* and 3*b* according to the present invention.
Figure 3A:
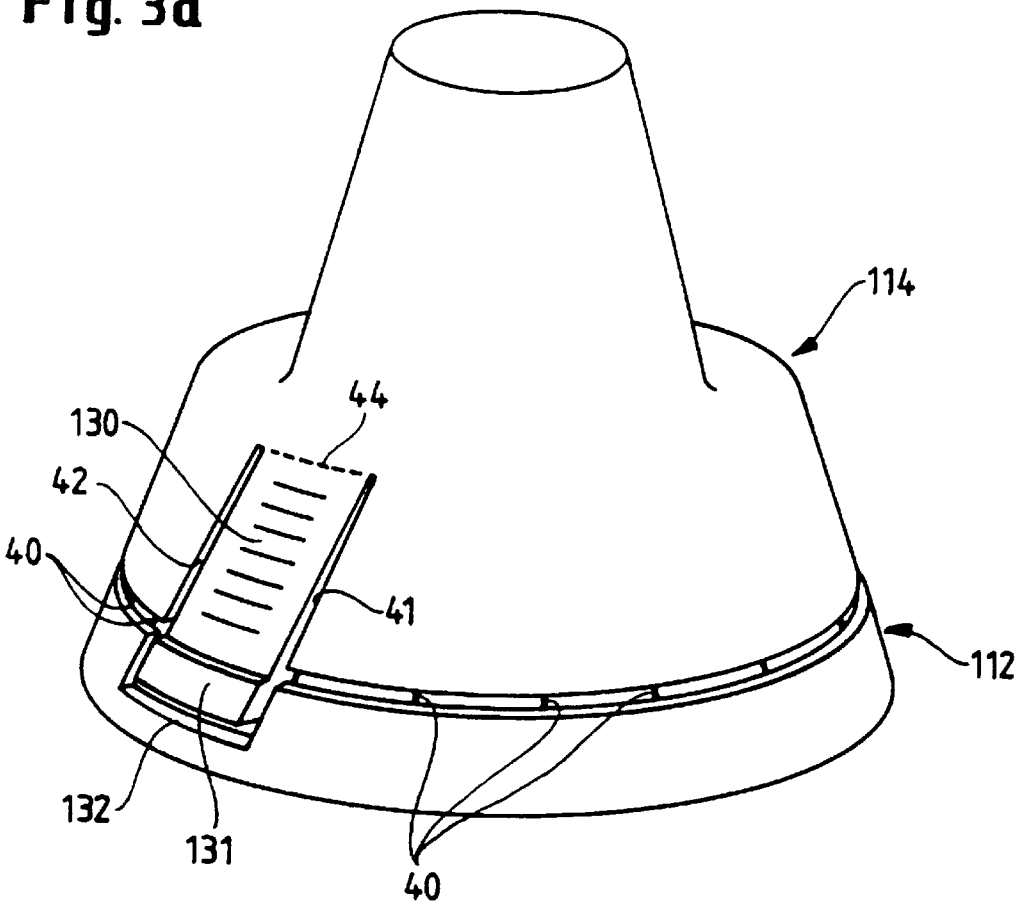

An example of a transition piece (212) and a closure (214) according to the present invention comprising as first and second engaging means a snapping mechanism is shown in FIGS. 2*b* and 3*b*. FIG. 2*b* shows the embodiment needing a two hand operation, whereas FIG. 3*b* shows the embodiment needing only a one hand operation. The outer shape of the transition piece and the closure in FIG. 2*b* is similar to the embodiment shown in FIG. 2*a*. The only difference is now the upward or downward vertical extension (231) of the pushtab (230). The upward or downward vertical extension comprises a lug (FIG. 2*c*, 233). Said lug interacts with said interlocking tooth (232) on the closure to achieve a child resistant closure of the package according to the present invention. Specifically, said lug interacts with said interlocking tooth in such a manner that said closure cannot be pulled off from the corresponding container before said pushtab is pressed. Indeed, only when pushing on said pushtab allows said lug to get free from said interlocking tooth, and consequently to pull off said closure from said container.

In a p referred embodiment said lug and said interlocking tooth are made as shown in FIGS. 2*b* and 2*c*. Said lug comprises a lateral extension (234) comprising a flat lower wall (235). Said extension may have a cylindrical shape. Preferably, said extension has a semi-rounded cylindrical shape as shown in FIG. 2*c* which facilitates an easy snap-on and snap-off of said closure from said container. Said interlocking tooth is formed by a cut through the thickness of the closure following the external shape of the pushtab and partially of the pushtab. In particular, the interlocking tooth comprises at least an arm (237) which interacts with the lower wall (235) of the upward or downward vertical extension. Said arm of the interlocking tooth and said lug interact with each other in such a manner that said arm is located under said lower wall when said closure is in its closed position on said container, as shown in FIG. 2*b*. Consequently, in this position said closure cannot be simply pulled off from said container. Indeed, when trying to pull off said closure with an upward movement, said arm of the interlocking tooth comes in interaction with the lower wall of the upward or downward vertical extension. Thereby a further upward movement of said closure is prevented.

The only way to open said container is first to push on said pushtab (230), thereby inwardly deflecting the up ward or downward vertical extension further within the cut forming the interlocking tooth. Consequently, the lug (233) is pushed away from the arm (237) of the interlocking tooth. Said closure can be easily pulled off once said lug is not aligned anymore to the arm. We found that this provides child resistance to said closure according to the present invention. When said closure is snapped onto said container, said lug passes on one side of said cut forming the interlocking tooth. Thereby the pushtab is deflected. Once said lug of the upward or downward vertical extension has overpassed said arm, said pushtab returns to the undeflected position where the lug is positioned within the interlocking tooth. The same principle and mechanism applies to the embodiment of FIG. 3*b* only that the positioning of the pushtab and the interlocking tooth is reversed with respect to the embodiment of FIG. 2*b*. However, the embodiment of FIG. 3*b* allows a one hand operation, as already described for FIG. 3*a*.

As described before, said pushtab (30) is the part of said closure or of said transition piece interacting with said interlocking tooth (32). Said pushtab may be part or attached to said outer (23) or inner skirt of said closure. Alternatively, said pushtab may be part or attached to said outer wall (20) of said transition piece. Said pushtab has an exposed outermost surface contour which generally conforms to the exterior outermost surface contour of the adjacent portions of said outer skirt or outer wall. This minimizes the chance of inadvertent depression of said pushtab when said outer skirt is grasped. Said pushtab may be positioned anywhere on said outer skirt, e.g. at different distances from the top wall.

Figure 4:
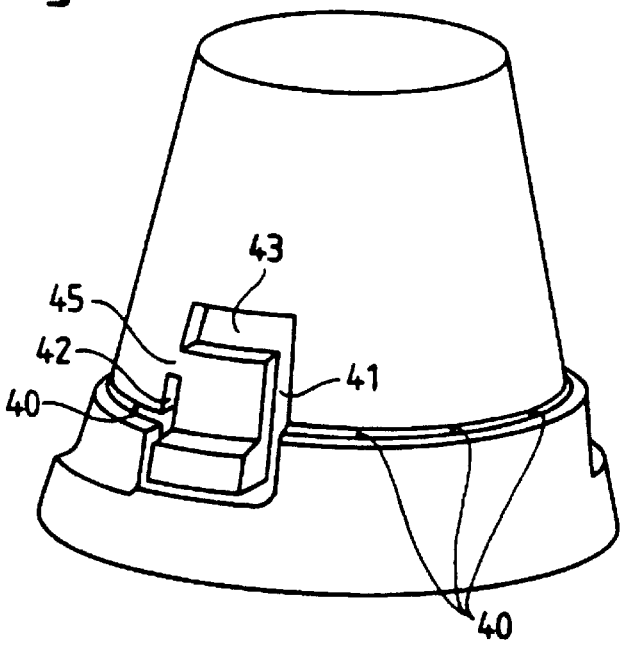
FIG. 4 is a perspective front view of another closure and transition piece for a child resistant package according to the present invention.

In FIGS. 2*a* to 3*b* said pushtab is formed by at least a pair of parallel slots (41, 42). In this manner, said pushtab is fixed to said outer wall or outer skirt along the drawn line (44) perpendicular to said slots. Therefore, said pushtab is cantilevered with respect to said outer wall of said transition piece or to said outer skirt of said closure. Another possibility is shown in FIG. 4, in which said pushtab is part of said outer skirt, formed by three slots (41, 42 and 43) and connected to said outer skirt through the transition portion (45). The same principles can be applied when said pushtab is part of said outer wall of said transition piece.

Figure 5A:
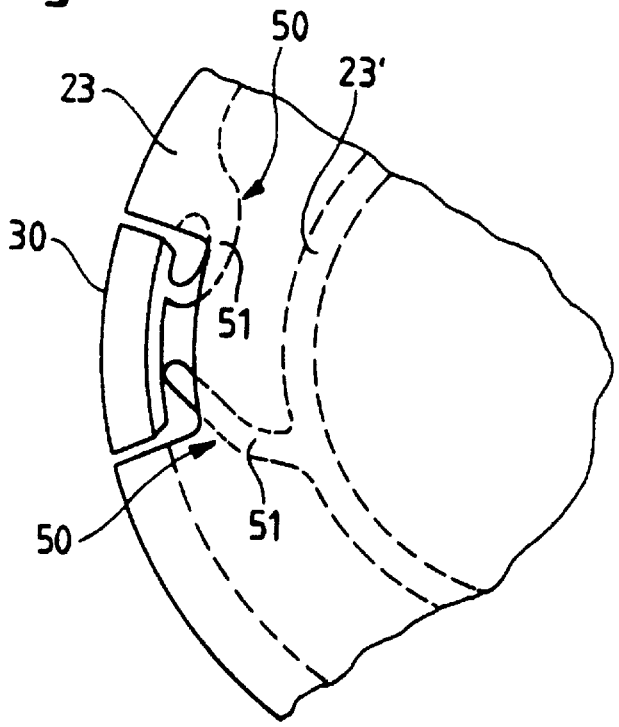
FIGS. 5*a* and 5*b* are cross sectional plane views of a child resistant closure according to the present invention.
Figure 5B:
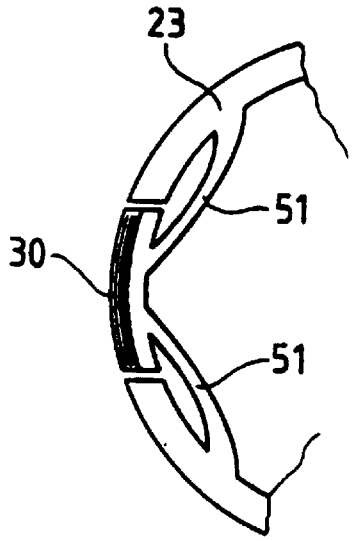

As a preferred option, a spring (50) may be located between said pushtab (30) and the innermost surface of said outer skirt (23) or the outermost surface of said inner skirt (23') of, said closure, as illustrated, for example, in FIG. 5*a* in a cross sectional plane view. In this case, said spring is made of a flexible and resilient arm (51). Preferably, said spring is attached to or is part of the innermost surface of said outer skirt at one end and attached to or leant against said pushtab at the opposite end of said flexible and resilient arm. In this case, said outer skirt (23) comprises a cut through the thickness of said outer skirt. Said cut has substantially the same dimension of said pushtab, giving complete access to said pushtab from the outside of said closure and fully accommodating said pushtab (30). As an alternative embodiment said spring may comprise two flexible and resilient arms (51) attached to or part of the innermost surface of the outer skirt as shown in FIG. 5*b*.

According to the present invention the package comprises said closure and said transition piece made in a single molding process. This is achieved by having said closure and said transition piece connected to each other by a breakable connection. This breakable connection allows to the molding in a single piece of said closure and said transition piece. This breakable connection enables to disconnect said closure and said transition piece from each other when said package is opened for the first time. This breakable connection further enables the user to check, when buying the package according to the present invention filled with a product, that said package has not been opened before by someone else. Preferably, said breakable connection comprises at least a break-off spur (40). Said break-off spurs connect said closure (14) to said transition piece. This attachment achieved with said break-off spurs is easily broken off when said package is opened for the first time.

Preferably, said closure (12) and said transition piece (14) are made of thermoplastic material. Such thermoplastic materials have been extensively described in the art and include vinyl chloride based resins, polymers and co-polymers derived from olefins, acrylic polymers and co-polymers, polyethylene, polypropylene, polystyrene, polyethylene terephthalate, polyethylene terephthalate glycol, or mixtures thereof. Said closure and said transition piece can be made of single or multi-layer extrusion of such materials. It can also comprise recycled thermoplastic materials. A preferred thermoplastic material used herein is polypropylene. Different parts of said closure or of said transition piece, like said pushtab (30) or said spring (50), may be made of a different thermoplastic material than said outer wall (20) or outer skirt (14) or top wall (24). Parts of different thermoplastic material may be co-injected together.

Indeed, we found that said pushtab or spring of different forms (FIGS. 6*a* and 6*b* for example) or of a different material with respect to the rest of said closure or of said transition piece allows to vary the flexibility of said pushtab, i.e. to vary the force needed to be applied on said pushtab.

What is claimed is:

1. A child-resistant package comprising a container (10), a closure (14) and a transition piece (12), said container comprising an upper portion (15), said upper portion comprising a first attachment means (21) for fixing said transition piece to said container and a first engaging means (22) for engaging said closure to said container, said transition piece comprising an outer wall (20) and a second attachment means corresponding to said first attachment means of said upper portion of said container, said closure comprises an outer skirt (23) and a top wall (24), said closure further comprising a second engaging means corresponding to said first engaging means of said upper portion of said container, said transition piece and said closure comprising a child resistant means, said child resistant means comprising at least one resiliently deformable pushtab (30) interacting with a corresponding interlocking tooth (32), at least part of said pushtab being inwardly movable when a squeezing force is applied to said inwardly movable part of said pushtab, said pushtab having an exposed surface contour which generally conforms to the exterior surface contour of the adjacent portions of said outer wall of said transition piece or of said outer skirt of said closure, said interlocking tooth and said pushtab being so formed and positioned to prevent removing of said closure from said container to open said package unless said pushtab is first depressed to disengage said pushtab from said interlocking tooth before said closure is removed, at least part of said pushtab passing adjacent to the innermost surface of said interlocking tooth when disengaging said closure from said container, wherein a breakable connection (40) connects said closure with said transition piece such that said transition piece and said closure are molded as a single piece in one molding process and said closure can be disconnected from said transition piece when said package is opened for the first time.

2. A package according to claim 1 wherein said breakable connection comprises at least a break-off spur (40).

3. A package according to claim 1 wherein said transition piece (12) comprises at least an interlocking tooth (32).

4. A package according to claim 3 wherein said transition piece (12) further comprises at least a cut through the thickness of said transition piece, said cut being dimensioned to fully accommodate said pushtab (30).

5. A package according to claim 3 wherein said pushtab (30) comprises a downward vertical extension (31).

6. A package according to claim 1 wherein said closure (14) comprises at least an interlocking tooth (32).

7. A package according to claim 6 wherein said pushtab (30) comprises a upward vertical extension (31).

8. A package according to claim 1 wherein said closure (14) comprises an inner wall (23').

9. A package according to claim 8 wherein said pushtab (30) is connected with a spring (50) to said innermost surface of said outer skirt (23) of said closure (14) and/or to said outermost surface of said inner wall of said closure.

10. A package according to claim 1 wherein said closure (14) or said transition piece (12) comprises two pushtabs opposite to each other.

* * * * *